US008727659B1

(12) United States Patent
Reynolds et al.

(10) Patent No.: US 8,727,659 B1
(45) Date of Patent: May 20, 2014

(54) MANHOLE COVER WITH INSERT

(71) Applicant: EJ USA, Inc., East Jordan, MI (US)

(72) Inventors: Dean W. Reynolds, Elmira, MI (US); Jeremy I. Johnson, East Jordan, MI (US)

(73) Assignee: EJ USA, Inc., East Jordan, MI (US)

( * ) Notice: Subject to any disclaimer, the term of this patent is extended or adjusted under 35 U.S.C. 154(b) by 0 days.

(21) Appl. No.: 13/789,754

(22) Filed: Mar. 8, 2013

(51) Int. Cl.
*E02D 29/14* (2006.01)

(52) U.S. Cl.
USPC ..... 404/25; 52/20

(58) Field of Classification Search
USPC ..... 49/463, 465; 52/20, 125.2; 404/25
See application file for complete search history.

(56) References Cited

U.S. PATENT DOCUMENTS

| | | | | | |
|---|---|---|---|---|---|
| 1,016,081 | A * | 1/1912 | McNulty | 49/465 |
| 1,833,794 | A * | 11/1931 | Redmann | 49/41 |
| 1,926,595 | A * | 9/1933 | Mulvihill | 49/41 |
| 2,086,318 | A * | 7/1937 | Jackson | 414/451 |
| 2,323,886 | A * | 7/1943 | Wirz, Jr. | 292/304 |
| 2,655,399 | A * | 10/1953 | McMillan | 294/17 |
| 4,101,236 | A * | 7/1978 | Meyer | 404/25 |
| 4,175,781 | A * | 11/1979 | Dumortier | 292/218 |
| 4,203,686 | A * | 5/1980 | Bowman | 404/25 |
| 4,364,689 | A * | 12/1982 | Dumortier | 404/25 |
| 4,523,407 | A * | 6/1985 | Miller | 49/465 |
| 4,662,777 | A * | 5/1987 | Newton | 404/25 |
| 4,726,707 | A * | 2/1988 | Newton | 404/25 |
| 4,964,755 | A * | 10/1990 | Lewis et al. | 404/25 |
| 5,312,202 | A * | 5/1994 | Newton | 404/25 |
| 5,865,425 | A * | 2/1999 | Meadows | 254/131 |
| 6,202,986 | B1 * | 3/2001 | Goldman | 254/131 |
| 6,595,566 | B1 * | 7/2003 | Donnan | 294/16 |
| 6,655,093 | B1 * | 12/2003 | Gavin | 52/20 |
| 6,739,796 | B1 * | 5/2004 | Del Nero et al. | 404/25 |
| 6,986,227 | B1 * | 1/2006 | Gavin | 52/20 |
| 7,243,515 | B2 * | 7/2007 | Meyer | 70/269 |
| 7,484,908 | B2 * | 2/2009 | Stadler | 404/25 |
| 7,484,909 | B2 * | 2/2009 | Brady et al. | 404/25 |
| 7,905,679 | B2 * | 3/2011 | Vrondran et al. | 404/25 |
| 8,061,928 | B2 * | 11/2011 | Jurich et al. | 404/25 |
| 8,118,517 | B2 * | 2/2012 | Kelley et al. | 404/25 |
| 8,347,670 | B2 * | 1/2013 | Rix | 70/168 |
| 8,454,263 | B2 * | 6/2013 | Lorenz | 404/25 |
| 2005/0280270 | A1 * | 12/2005 | Howard, Jr. | 294/17 |
| 2006/0021396 | A1 * | 2/2006 | Javaux et al. | 70/168 |
| 2011/0133140 | A1 * | 6/2011 | Shepherd | 254/131 |
| 2012/0027559 | A1 * | 2/2012 | Farbos et al. | 414/800 |

* cited by examiner

*Primary Examiner* — Katherine Mitchell
*Assistant Examiner* — Justin Rephann
(74) *Attorney, Agent, or Firm* — Warner Norcross & Judd LLP

(57) ABSTRACT

A manhole cover includes a cover panel formed from a first material, which may be a generally lightweight material, and an insert formed within a cutout in the first material. The insert may be formed from a higher strength material and may include one or more openings for receiving conventional cover removal tools. In one embodiment, the manhole cover includes a cover panel having a peripheral edge and defining a diameter, and further defining an opening or cutout that is spaced from the peripheral edge. The insert is disposed in the opening. The insert may include an upper surface and a lower surface opposite the upper surface, the insert defining first and second openings in the upper surface, with the first opening shaped to receive a first removal tool and the second opening shaped to receive a second removal tool.

10 Claims, 8 Drawing Sheets

MANHOLE COVER WITH INSERT

BACKGROUND OF THE INVENTION

The present invention relates to a manhole cover assembly, and more particularly to a manhole cover having an insert including structure for removal of the manhole cover from a frame.

Manholes are well-known and widely utilized. Generally, a manhole provides access for maintenance of infrastructure, for instance, underground pipelines or cabling. Traditional manhole covers rest on a frame that is attached to the substructure above infrastructure to be maintained. Examples of such substructure include the base for a road or sidewalk. The cover rests on this frame and must be lifted away to gain access to the infrastructure beneath the manhole. Because manhole covers are predominantly made of iron and can weigh in excess of 100 pounds, the effort required to lift a manhole cover can be difficult and even injurious to the operator.

Many attempts have been made to ease the effort required to lift a manhole cover from its frame. Some of these attempts have involved the development of special cover removal tools and corresponding openings in the cover for insertion of the tool into the opening for removal of the cover from the frame. For example, some manhole covers include a hole extending through the cover. To lift the cover, an operator inserts a pointed tool through the hole to either pry up or lift the cover. This method provides some additional lifting leverage, but the hole in the cover provides direct access for external contaminants to drain below to the infrastructure. Other attempts at easing manhole cover removal have been directed at reducing the weight of the cover. One example is the composite manhole cover, which may be formed from a polymer reinforced with fibers such as glass fibers. Unfortunately, many of the cover removal tools developed for use with cast iron covers can be difficult to use with composite covers, because the composite covers cannot be formed with the strength characteristics to support the prying or lifting forces presented by conventional cover removal tools.

SUMMARY OF THE INVENTION

The present invention provides a manhole cover that includes a cover panel formed from a first material, which may be a generally lightweight material, and an insert formed within a cutout in the first material. The insert may be formed from a higher strength material and may include one or more openings for receiving conventional cover removal tools. In one embodiment, the manhole cover includes a cover panel having a peripheral edge and defining a diameter, and further defining an opening or cutout that is spaced from the peripheral edge. The insert is disposed in the opening. The insert may include an upper surface and a lower surface opposite the upper surface, the insert defining first and second openings in the upper surface, with the first opening shaped to receive a first removal tool and the second opening shaped to receive a second removal tool.

In one embodiment, the first material is a reinforced polymer composite, which may be a polymer reinforced with glass fibers, and the second material is a stainless steel. The composite material may significantly reduce the overall weight of the cover, while the stainless steel insert continues to provide added strength in the areas where increased forces will be focused due to the use of the removal tools. The insert may be molded into the cover panel, for example, by placing the insert into a mold and molding the cover panel about the insert using standard composite molding processes. Other types of materials may be used for either the cover panel or the insert to provide the cover with desired strength and weight characteristics for a particular application.

In another embodiment, the first and second openings are aligned in a particular direction to enable easy use of either the first or second type of removal tools to remove the cover from its frame. For example, the first removal tool may be a j-hook style cover removal tool and the second removal tool may be a keyhole style removal tool. The insert may include an upper wall and lower wall that are spaced apart to define a channel, and the first and second openings may be keyhole shaped opening to receive the keyhole tool and the second opening may be configured to receive a j-hook tool. In one embodiment, the floor of the channel curves upwardly to meet the upper wall of the insert in the area underneath the j-hook style insert to enable use of the j-hook tool in the second opening. The upper wall of the insert may include a lifting bar that extends across the width of the channel between the first and second openings. The lifting bar and the curved floor of the channel enable use of the j-hook opening to receive the j-hook tool.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and capable of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENT

Figure 1:
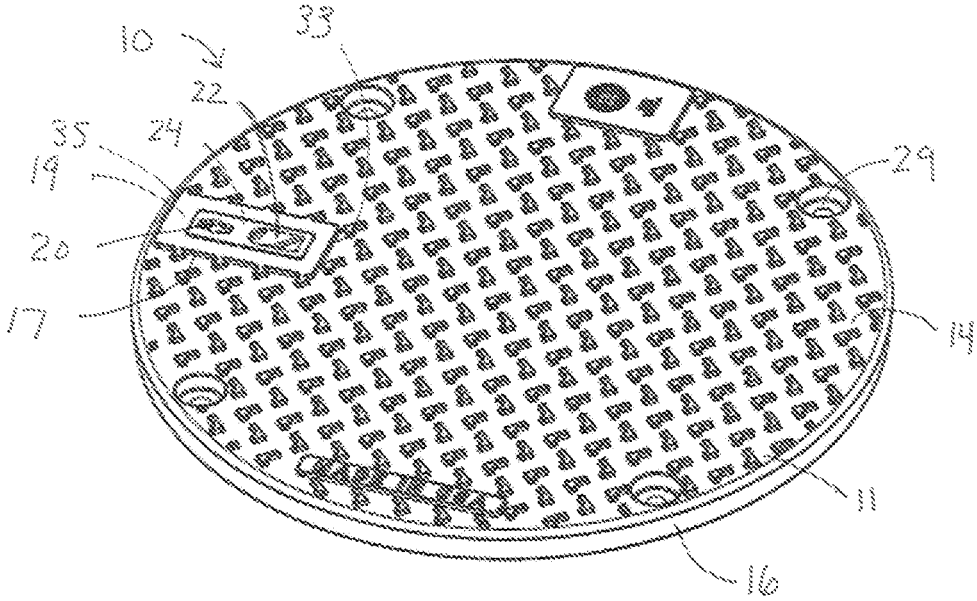
FIG. 1 is a perspective view of a manhole cover according to one embodiment of the present invention.
Figure 2:
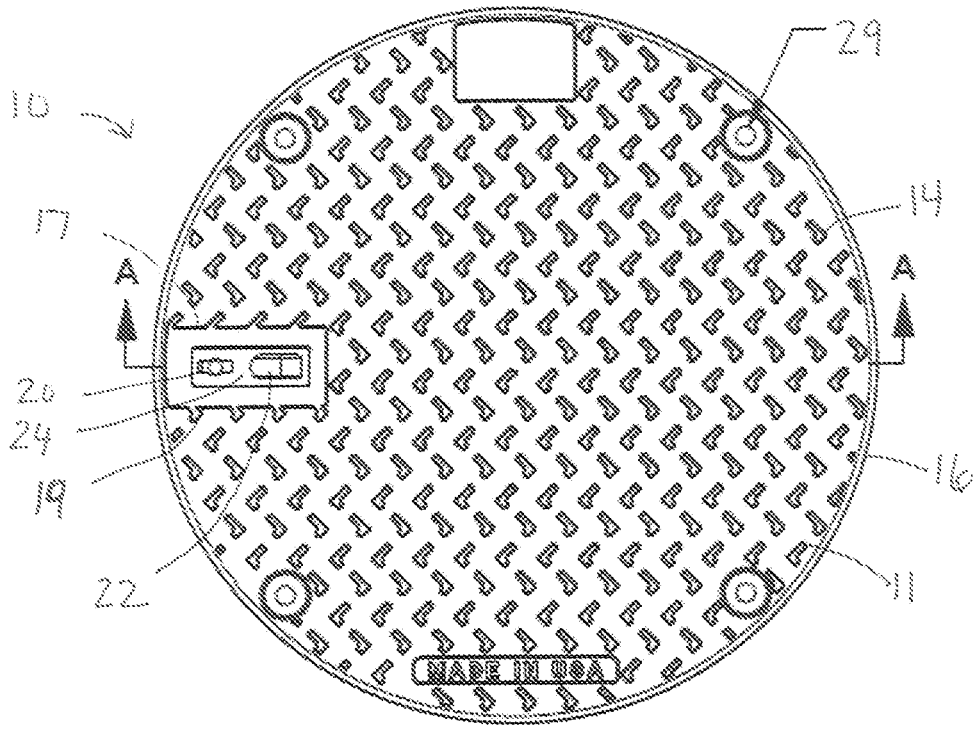
FIG. 2 is a top view thereof.
Figure 3:
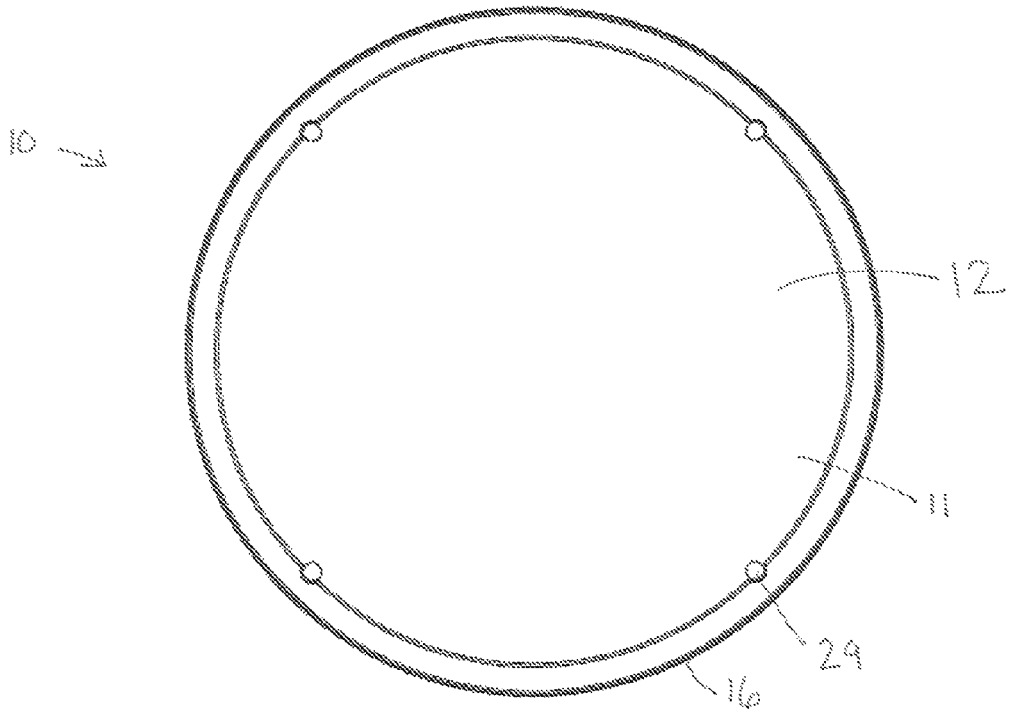
FIG. 3 is a bottom view thereof.
Figure 4:
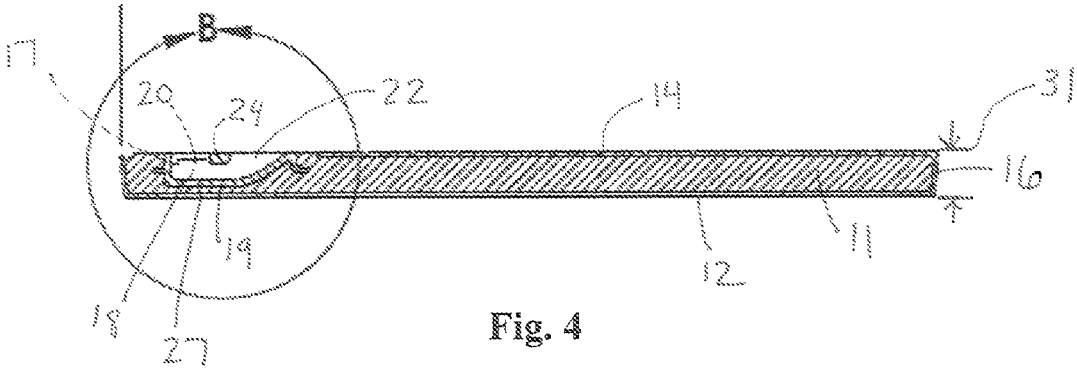
FIG. 4 is a side cross sectional view taking along line A-A in FIG. 2.
Figure 5:
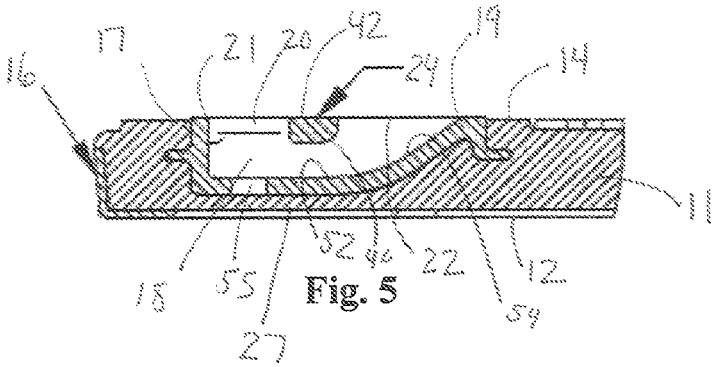
FIG. 5 is a close up view of the portion of the cover designated within circle "B" in FIG. 4.
Figure 6:
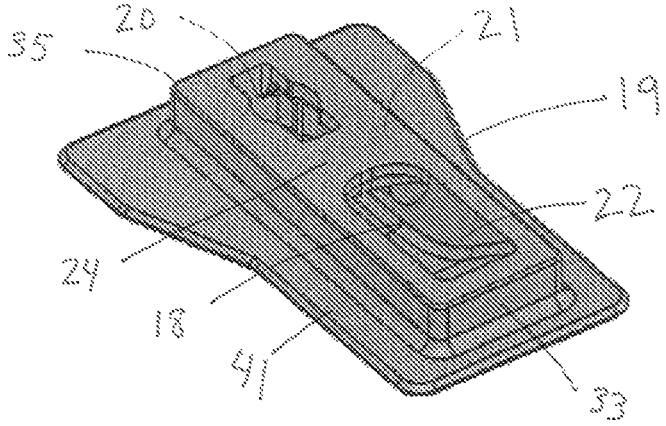
FIG. 6 is a perspective view of an insert according to one embodiment of the present invention.
Figure 7:
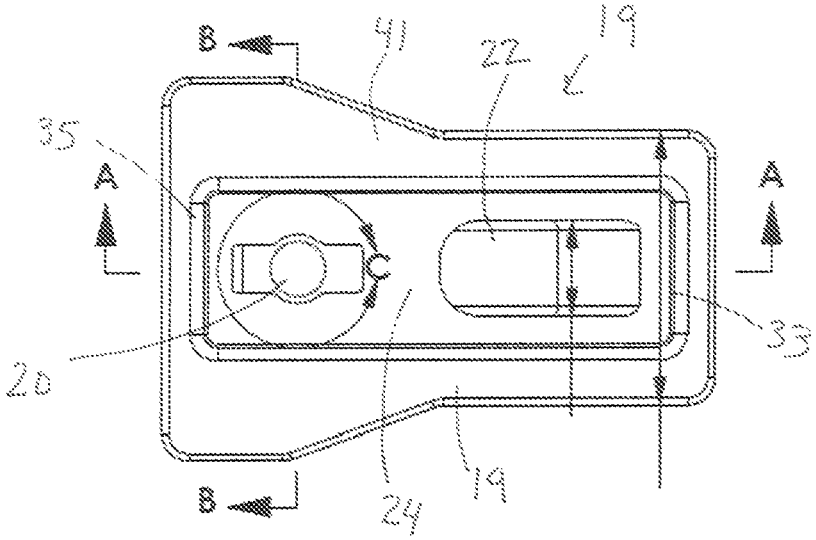
FIG. 7 is a top view thereof.
Figure 8:
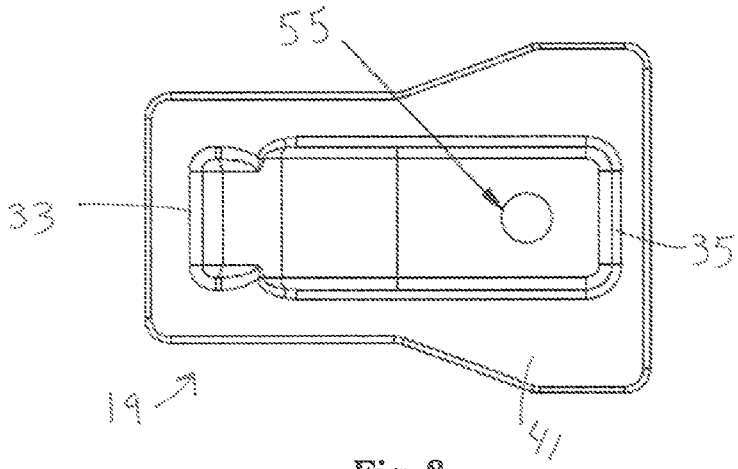
FIG. 8 is a bottom view thereof.
Figure 9:
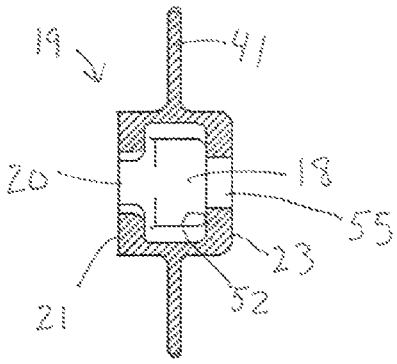
FIG. 9 is a cross sectional view of the insert taken along line B-B in FIG. 7.

A manhole cover in accordance with one embodiment of the present invention is illustrated in the drawings and designated 10. In illustrated embodiment, the cover 10 includes a cover panel 11 that has a lower face 12, an upper face 14, an outer circumferential edge 16, an opening or cutout 17 defined in the cover panel 11, and an insert 19 disposed in the opening 17. In one embodiment, the insert 19 includes an upper wall 21 and a lower wall 23, and a channel 18 defined therebetween. In one embodiment, the upper wall 21 includes a lifting bar 24 positioned between a keyhole opening 20 and a j-hook opening 22. In operation, as illustrated in FIGS. 1-2, the cover 10 can be removed from the frame 26 in multiple ways, for instance, by inserting an keyhole tool 70 into the keyhole opening 20 or a j-hook tool 60 into the j-hook lifting opening 22. The insert 19 may be spaced from the outer circumferential edge 16 and may optionally include a drainage hole 55 that provides means for fluid and debris to drain from the lifting channel 18.

The cover 10 may be formed from a variety of materials. In one embodiment, the cover panel 11 is formed from a composite material, such as a reinforced polymer composite. For example, the cover panel 11 may be manufactured by injection molding a polymer or resin such as nylon, urethane, polyester, epoxy, phenolic and the like. The polymers may be reinforced, for instance, by glass or fiber, including fiberglass, carbon fiber and aramid. The percentage of resin and fiber reinforcing material used in production of the cover panel may vary from application to application based on the strength requirements. In an alternative embodiment, the cover panel 11 may be formed from another material, such as cast iron. As shown, the cover panel 11 is formed with an overall disc-shaped geometry, although other shapes and sizes may be used, depending on the application.

The insert 19 may also be formed from a variety of materials. In one embodiment, the insert 19 may be formed from stainless steel; however, the insert may otherwise be formed from brass, cast iron, or a composite material of the same or different composition as the cover panel 11. The stainless steel insert 19 may be formed with a composite cover panel 11 by inserting the stainless steel insert 19 into a mold, and then injecting the composite material into the mold and into the shape of the cover panel 11. In one embodiment, the insert 19 is molded into the cover panel 11 such that an opening or cutout 17 is formed in the cover panel 11, and the insert 19 is disposed therein. In the illustrated embodiment, a cutout 17 is formed in the upper face 14 of the cover panel 11 such that it does not completely extend through the cover panel 11. The insert 19 may extend through substantially all of the width of the cover panel, such as about 75% or more of the width of the cover panel. In another embodiment, the insert may extend through about 50% of the width of the cover panel, and in another embodiment the insert may extend completely through the cover panel 11 such that the insert 19 is exposed on the lower face 12 of the cover panel 11. As shown, the insert 19 is positioned in the cutout 17 extending substantially through the width of the cover panel 11 with the lower wall 23 of the insert 19 engaging the floor 27 of the cutout 17 and the upper wall 21 flush with the upper face 14 of the cover panel 11.

As noted above, the cover panel 11 has a lower face 12 and an upper face 14, and an outer circumferential edge 16 that defines the periphery of the cover panel 11. The cover panel 11 defines a thickness 31 between the upper face 14 and lower face 12. In one embodiment, the upper face 14 may include projections and designs that indicate the owner of the cover 10, the manufacturer, the type of infrastructure beneath the manhole or any other pattern. In another embodiment, wherein the cover panel 11 is formed by injection molding, a variety of slip-resistant textures and patterns may be molded into the upper face 14. In the illustrated embodiment, the cover panel 11 further includes four spaced apart holes 29 extending through the cover 11 for securing the cover panel 11 to a frame 26. In another embodiment, the cover panel 11 may not include such holes 29 or may have a different number of holes 29.

The cover 10 is adaptable to be received by many different frame configurations. In the embodiment illustrated in the figures, the lower face 12 of the cover 10 rests on a cover support rim 28 of a frame 26. The frame 26 may include a frame wall 30 rising away from the substructure the frame 26 is mounted on. The frame wall 30 is an annular ring defining an inner surface 32. The cover support rim 28 projects from the inner surface 32 of the frame wall 30. An upper segment 34 of the frame wall 30 may extend beyond the cover support rim 28. The upper edge 31 of the upper segment 34 may be flush with the upper surface 14 of the cover when the cover 10 is in place on the cover support rim 28. The inside diameter of the frame wall 30 is slightly greater than the diameter of the cover 10 to provide clearance between the upper segment 34 of the frame wall 30 and the outer circumferential edge 16 of the cover 10 when the cover is installed on the frame 26. In another embodiment, the lower face of the cover could rest directly on the annular top of the frame wall.

Referring to FIGS. 4-11, in the illustrated embodiment, the insert 19 is disposed with in the cutout or opening 17 in the cover panel 11. In one embodiment, the insert 19 includes an upper wall 21 and a lower wall 23. As illustrated, the insert includes a first end 33 and a second end 35 opposite the first end 33 defining a length of the insert 19 therebetween. The upper and lower walls 21 and 23 may be spaced from each other for a at least a portion of the length of the insert 19, defining a channel 18 in the insert 19. A pair of openings are defined in the upper face 14 to provide access to the channel 18. The openings include a keyhole opening 20 and a j-hook opening 22. In the illustrated embodiment, the insert 19 includes a flange 41 extending around the periphery of the insert 19. The flange 41 may vary in width at different locations around the insert 19. For example, in one embodiment, the flange 41 has a generally uniform width extending from the first end 33 through about one half of the length of the insert 19, and then widens to a second width nearer to the second end 35. As described in more detail below, the flange 41 may be used to form a mechanical connection between the insert 19 and the cover panel 11, wherein the flange 41 is surrounded by the cover panel as the cover panel 11 is molded about the flange 19.

In one embodiment, the insert 19 is positioned in the cover panel 11 such that the insert is spaced from the peripheral edge of the cover panel 11. In the illustrated embodiment, the insert 19 is positioned such that the openings 20, 22 are aligned along a diameter of the cover panel, and more particularly, with the keyhole opening 20 positioned closer to the edge 16 of the cover panel 11 than the j-hook opening 22. In an alternative embodiment, the insert may be positioned at the outer circumferential edge 16 of the cover panel 11. In one embodiment, two inserts 19 may be disposed on opposite sides of the cover 10.

The illustrated insert 19 includes a lifting bar 24 that is generally flush with the upper wall 21 and extends across the width of the channel 18. As illustrated, the lifting bar 24 bridges the channel 18 to form the ceiling of the channel 18. The lifting bar 24 divides the upper wall 21 into the keyhole opening 20 and the j-hook opening 22. In one embodiment, the lower wall 23 of the insert defines a floor 52 of the channel 18 that is spaced from the lifting bar 24. At least a portion of the floor 52 may be configured to receive a j-hook cover removal tool 60 through the j-hook opening 22 and a keyhole cover removal tool 70 through the keyhole opening 20. In one embodiment, the floor 52 includes an j-hook arc 54 that forms a smooth, arcing surface under the lifting bar 24 that ramps upwardly from a j-hook leverage face 56 that is spaced beneath the upper wall 21 to the upper face 14 of the cover panel 11. The j-hook leverage face 56 is a generally flat surface that extends underneath the keyhole opening 20 and is parallel to the overall plane of the cover 10. The upper surface 42 of the lifting bar 24 may be flush with the upper face 14 of the cover panel 11. In one embodiment, the lifting bar 24 may include a rounded curve on a lower surface 40 of the lifting bar 24 adjacent to the j-hook opening 20 and above the j-hook arc 54. A sidewall 50 may also transition via a slightly rounded curve into the generally flat portion of the lower surface 40.

Figure 10:
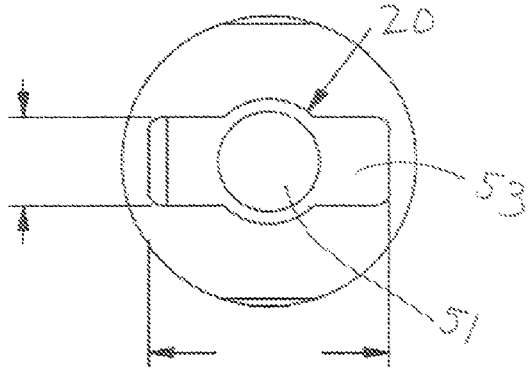
FIG. 10 is a close up view of the portion of the insert designated within circle "C" in FIG. 7.
Figure 11:
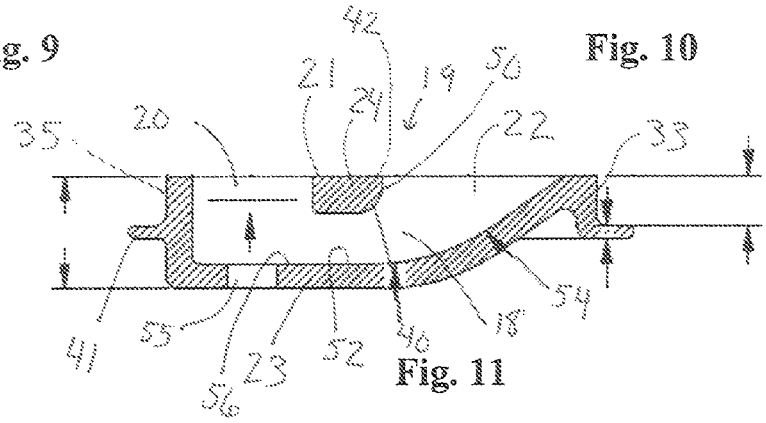
FIG. 11 is a side cross sectional view of the insert taken along line A-A in FIG. 7.
Figure 12:
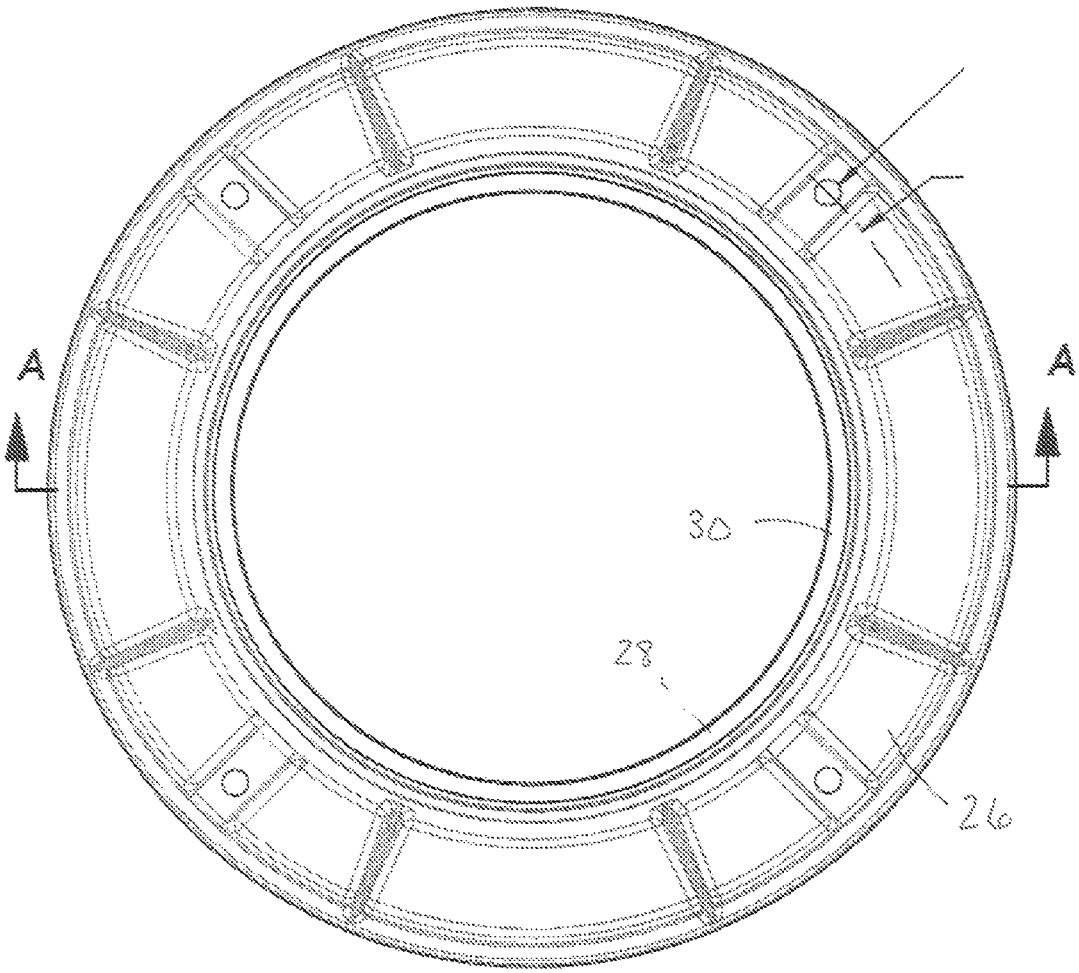
FIG. 12 is a top view of a frame according to one embodiment.
Figure 13:
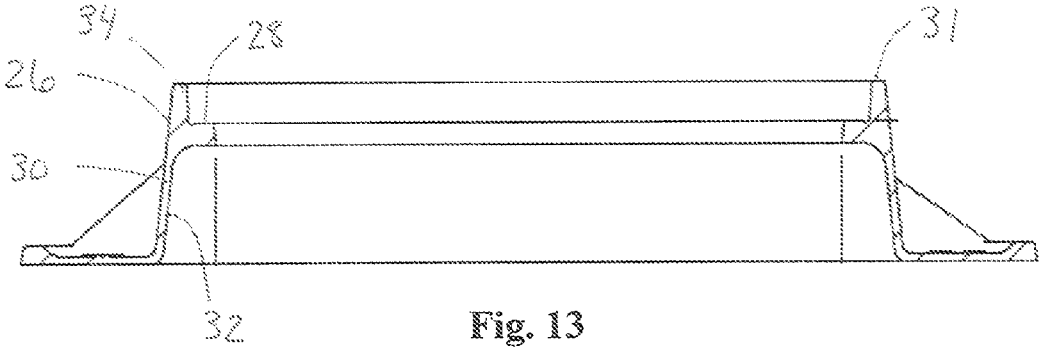
FIG. 13 is a side cross sectional view of the frame taken along line A-A in FIG. 12.

The keyhole opening 20 is shaped to receive a keyhole cover opening tool 70. As illustrated in FIG. 10, the keyhole opening 20 includes a central circular opening 51 and a pair of opposing extensions 53 extending from the central opening 51. In the illustrated embodiment, the extensions are aligned along a diameter of the cover 10. In another embodiment, the keyhole opening 20 may have a different shape to match the shape of another style of keyhole tool. As noted above, the floor 52 channel 18 on the lower wall 23 of the insert is generally flat underneath the keyhole opening 20 and spaced from the upper wall 21 to provide space for the prongs 71 of the keyhole tool 70 to be inserted through the keyhole opening 20 and the rotated to lift the cover 10. In one embodiment, a drainage hole 55 may be defined in the floor 52 underneath the keyhole opening 20 such that the drainage hole 55 is aligned underneath the central opening 51 and extends completely through the lower wall 23 of the insert 19. In an embodiment such as the illustrated embodiment, wherein the insert 19 does not extend completely through the cover panel 11, an additional hole (not shown) may be formed in the cover panel 11 underneath the drainage hole 55 such that fluids and debris entering the channel 18 can drain out of the insert 19 through the drainage hole 55. The additional hole in the cover panel 11 may be formed by the manufacturer during the manufacturing process, or it may optionally be formed by a user, for instance, at the time of installation into the frame 26 by drilling through the cover panel 11. In another embodiment, the drainage hole 55 may be located at a different position within the channel 18.

Figure 14:
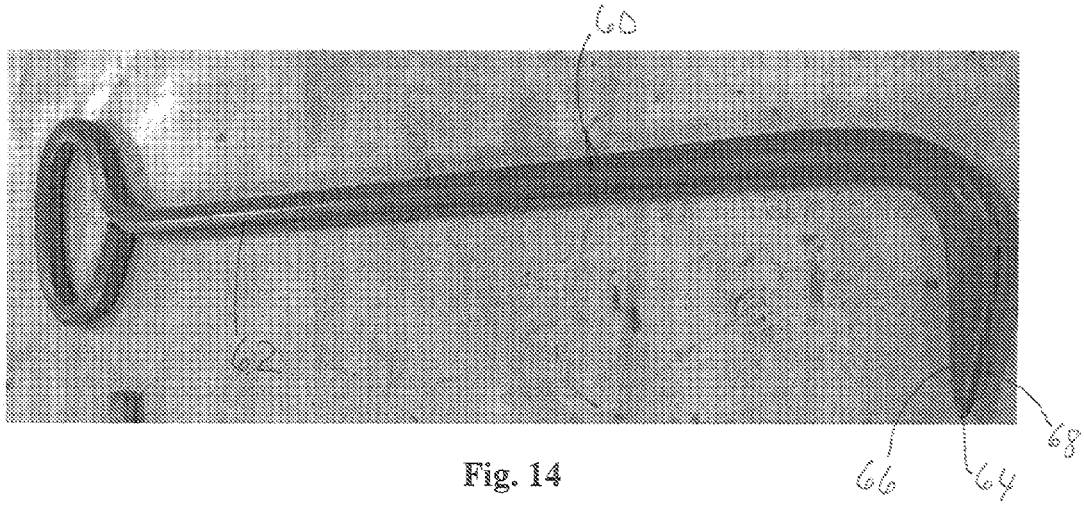
FIG. 14 is a top view of a j-hook style cover removal tool.
Figure 15:
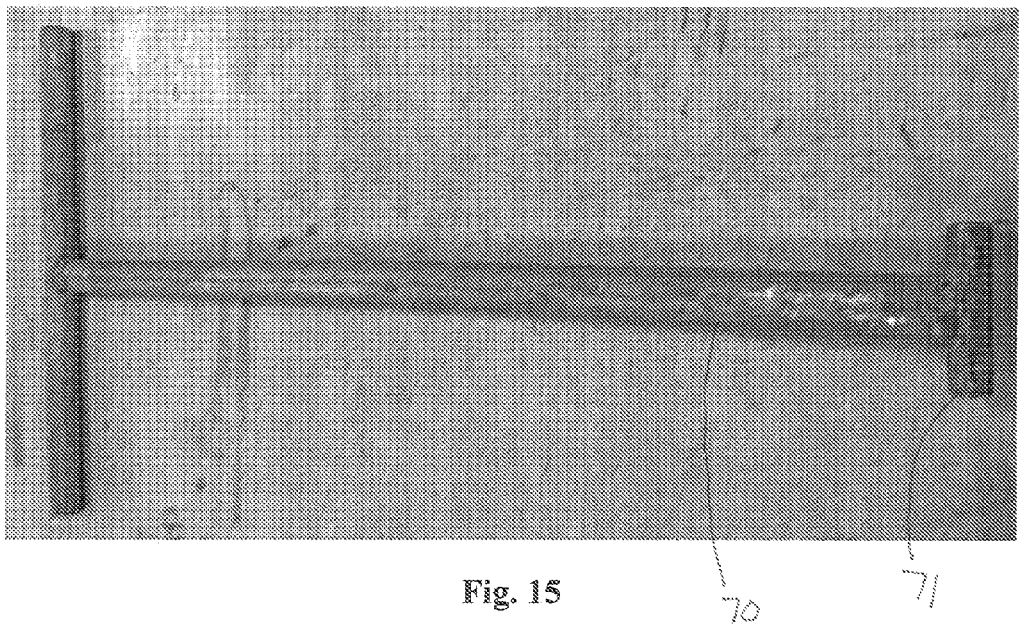
FIG. 15 is a top view of a keyhole style cover removal tool.

The second end 35 of the insert and the lifting bar 24 cooperate to define the j-hook opening 20. In the illustrated embodiment, the j-hook opening 20 is of an overall rectangular shape but the j-hook opening 20 could be of alternate geometries to receive tools 60 of various configurations. The j-hook opening 20 is configured to receive a hook-shaped j-hook lifting tool 60. As shown in FIG. 14, one such tool includes a handle 62, a point 64, an upper face 66 and a lower face 68. In this embodiment of the tool 60, the handle 62 makes an angle of approximately 60° with the upper face 66 and lower face 68 of the tool 60. Various other lifting tools 60 are suitable for use with the cover 10, and the specific configuration of the lifting channel 18 can be adapted for the geometry of various lifting tool designs. In alternative embodiments, the angle may be adjusted to accommodate alternative lifting sector configurations, frames, operator heights, etc.

In operation, the point 64 of the tool 60 is inserted through the j-hook opening 20, into the channel 18 and under the lifting bar 24. The arc shaped portion 54 of the channel 18 allows the tool 60 to enter the channel 18 with the lower face 68 of the tool 60 pressed against the channel floor 52, and the upper face 66 of the tool 60 pressed against the curved portion of the lower surface 40 of the lifting bar 24. The operator applies a lifting force to the handle 62 of the tool 60, and leveraging forces are applied to the floor 52 and the lifting bar 24 allowing the operator to lift the cover 10 up and away from the frame 26.

Figure 16:
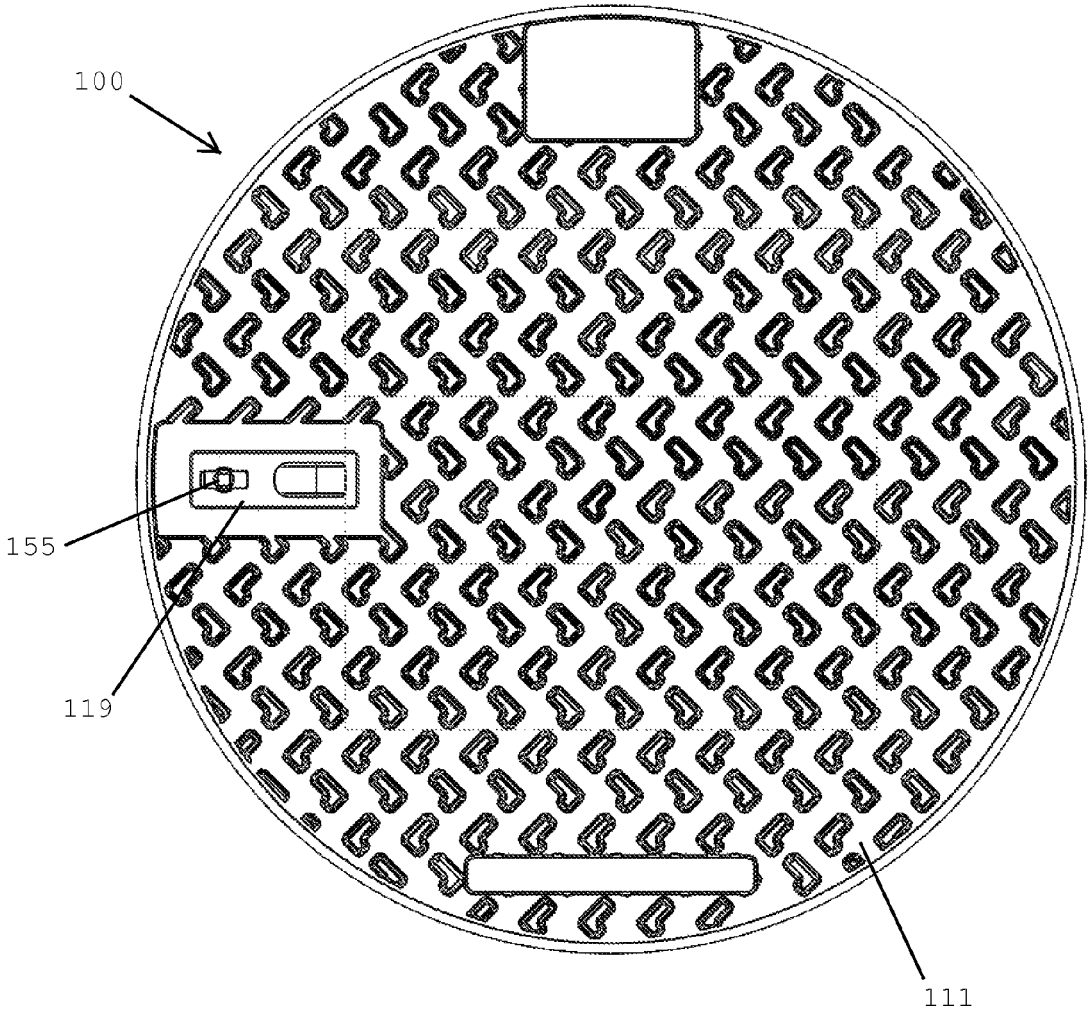
FIG. 16 is a top view of another embodiment of the manhole cover.
Figure 17:
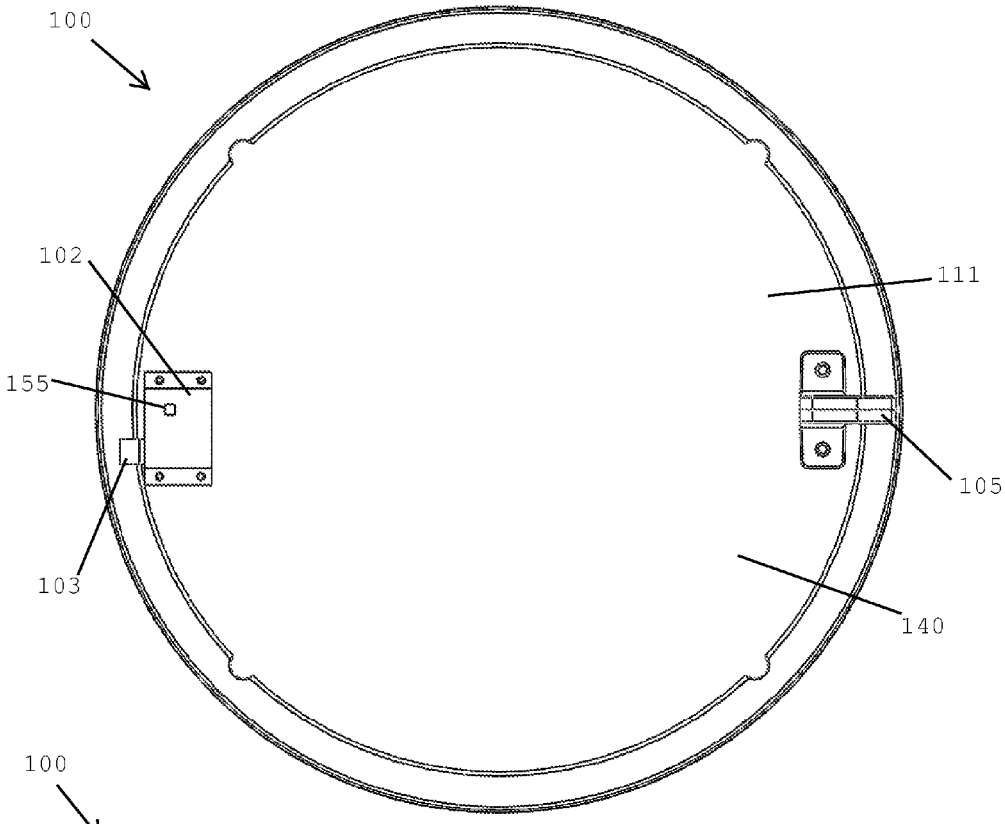
FIG. 17 is a bottom view thereof.
Figure 18:
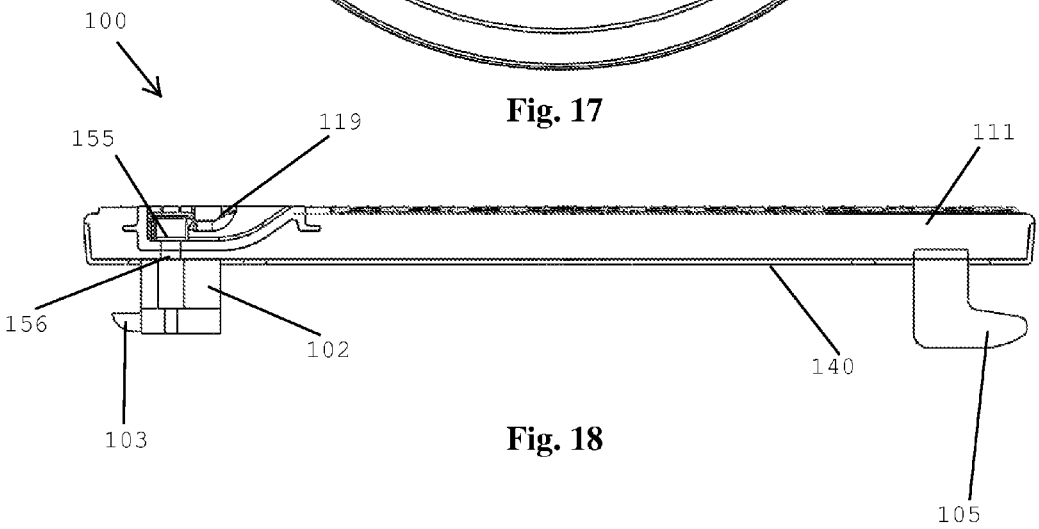
FIG. 18 is a side cross sectional view through the insert and latch member.

In alternative embodiments, the keyhole opening 20 and a j-hook opening 22 may be alternatively sized or shaped to accept different styles of tools. In other embodiments, the channel could be alternatively configured as well, based on the tool to be used. For example, an alternative embodiment designed for use with a latch-style cover 100 is shown in FIGS. 16-18. As shown in FIG. 17, the latch style cover 100 includes a latch mechanism 102 attached to the lower surface 140 of the cover panel 111. A latch member 103 can be moved from a latched position (shown in FIG. 17) to an unlatched position (not shown). In the latched position, the latch member 103 can extend underneath a portion of the frame. In this position, the latch member 103 and another locking member 105 combine to secure the cover 100 within the frame. In the unlatched position, the latch member 103 is moved toward the interior of the cover panel 111 such that it no longer extends underneath the frame. As illustrated in FIGS. 16-18, the insert 119 is located adjacent to the latch mechanism 102, and the insert 119 is provided with a through hole 155 with a shape designed to receive a latch tool (not shown) that can be inserted through the through hole 155 (and the correspondingly shaped hole 156 in the lower surface 140 of the cover panel 111) to engage the latch member 103 and move the latch member 103 to the unlatched position. In the illustrated embodiment, the through hole 155 is square in shape, although the shape may be varied depending on the latch tool.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The embodiments of the invention in which an exclusive property or privilege is claimed are defined as follows:

1. A manhole cover comprising:

a cover panel formed from a first material, said cover panel having a peripheral edge and defining a diameter, said cover panel defining an opening spaced from said peripheral edge; and an insert disposed in said opening, said insert formed from a second material different from said first material, said insert including an upper surface and a lower surface opposite said upper surface, said insert defining first and second openings in said upper surface, said first opening shaped to receive a first removal tool and said second opening shaped to receive a second removal tool, wherein said first opening is key-hole shaped to receive a key-style cover removal tool, and said second opening is shaped to receive a j-hook style cover removal tool, wherein said second opening includes a depth that gradually decreases approaching an edge of said second opening, wherein said insert defines a drainage hole in said lower surface said drainage hole generally aligned with said first opening.

2. The manhole cover of claim 1 wherein said first and second openings are aligned along said diameter.

3. The manhole cover of claim 1 wherein said first material is a reinforced polymer composite.

4. The manhole cover of claim 3 wherein said first material is a polymer reinforced with glass fibers.

5. The manhole cover of claim 4 wherein said second material is formed from stainless steel.

6. A manhole cover assembly comprising:

a manhole frame defining an access opening;

an injection molded composite cover sized to cover said access opening to prevent contaminants from entering said access opening, said cover molded to define an insert opening; and a steel insert disposed in said insert opening, said insert including an upper surface and a lower surface opposite said upper surface, said upper surface defining a keyhole shaped opening for receiving a keyhole style cover removal tool, said upper surface defining a j-hook opening for receiving a j-hook style cover removal tool, wherein said j-hook opening includes a first side and a second side, said j-hook opening having a gradually increasing depth extending away from said first side, wherein said cover includes a peripheral edge, and said first side is farther from said peripheral edge than said second side, wherein said keyhole shaped opening and said j-hook opening are aligned along a diameter of said cover, wherein said keyhole shaped opening is closer to said peripheral edge than said j-hook opening, wherein a drainage hole is defined in said lower surface of said insert to allow contents to pass through said insert, wherein said drainage hole is positioned underneath said keyhole shaped opening.

7. A manhole cover comprising:

a cover panel having a peripheral edge, an upper surface, a lower surface and a depth defined between said upper and lower surfaces, said cover panel defining a cutout extending into said upper surface and through a substantial portion of said depth of said cover panel, said cutout spaced from said peripheral edge; and an insert disposed in said cutout such that said insert is exposed on said upper surface of said cover panel, said insert formed from a different material than said cover panel, said insert including an upper wall and a lower wall, said upper wall defining a keyhole opening and a j-hook opening, said keyhole opening having a keyhole shape to receive a keyhole style cover removal tool, said insert defining a depth between said upper and lower walls, said lower wall being curved underneath said j-hook opening to gradually decrease said depth of said insert for receiving a j-hook style cover removal tool, wherein a drainage hole is defined in said lower surface of said insert to allow contents to pass through said insert, said drainage hole positioned underneath said keyhole shaped opening.

8. The manhole cover of claim 7 wherein said upper wall of said insert includes a lower surface spaced from said lower wall of said insert and facing said lower wall of said insert, said lower surface of said upper wall and said curved portion of said lower wall being aligned with each other to receive a j-hook style cover removal tool therebetween.

9. The manhole cover of claim 8 wherein said keyhole opening and said j-hook opening are aligned along a diameter of said cover panel, said keyhole opening positioned closer to said peripheral edge than said j-hook opening.

10. The manhole cover of claim 9 wherein said cover panel is formed from a reinforced polymer composite material and said insert is formed from a stainless steel material.

* * * * *